US008218955B2

(12) United States Patent
Witt

(10) Patent No.: US 8,218,955 B2
(45) Date of Patent: Jul. 10, 2012

(54) METHOD AND SYSTEM FOR REDUCING RESPONSE TIME IN BOOSTER WATER HEATING APPLICATIONS

(75) Inventor: Allan E. Witt, Lenoir, NC (US)

(73) Assignee: Hatco Corporation, Milwaukee, WI (US)

( * ) Notice: Subject to any disclaimer, the term of this patent is extended or adjusted under 35 U.S.C. 154(b) by 778 days.

(21) Appl. No.: 12/346,533

(22) Filed: Dec. 30, 2008

(65) Prior Publication Data

US 2010/0166398 A1 Jul. 1, 2010

(51) Int. Cl.
*A47J 27/00* (2006.01)
*F24H 1/20* (2006.01)

(52) U.S. Cl. ..... 392/441; 392/451; 392/453

(58) Field of Classification Search ..... 392/441–464
See application file for complete search history.

(56) References Cited

U.S. PATENT DOCUMENTS

| | | | | | |
|---|---|---|---|---|---|
| 2,580,659 | A | | 1/1952 | Corbett | |
| 3,566,078 | A | * | 2/1971 | Krackow | 219/486 |
| 3,952,182 | A | | 4/1976 | Flanders | |
| 4,413,775 | A | * | 11/1983 | Scott | 236/20 R |
| 4,467,183 | A | * | 8/1984 | Ishima | 219/497 |
| 4,521,674 | A | | 6/1985 | Scanlan et al. | |
| 4,740,673 | A | * | 4/1988 | Robinson, Jr. | 219/510 |
| 4,765,351 | A | * | 8/1988 | Clary | 134/56 D |
| 4,808,793 | A | | 2/1989 | Hurko | |
| 5,293,446 | A | * | 3/1994 | Owens et al. | 392/449 |
| 5,438,642 | A | | 8/1995 | Posen | |
| 5,506,931 | A | | 4/1996 | Leon | |
| 5,808,277 | A | * | 9/1998 | Dosani et al. | 219/481 |
| 5,898,818 | A | * | 4/1999 | Chen | 392/449 |
| 5,990,459 | A | | 11/1999 | Feustel et al. | |
| 6,058,245 | A | * | 5/2000 | McNamara, Jr. | 392/308 |
| 6,080,971 | A | | 6/2000 | Seitz et al. | |
| 6,080,973 | A | | 6/2000 | Thweatt, Jr. | |
| 6,137,955 | A | | 10/2000 | Krell et al. | |
| 6,178,291 | B1 | | 1/2001 | Zenios et al. | |
| 6,363,216 | B1 | * | 3/2002 | Bradenbaugh | 392/463 |
| 6,363,218 | B1 | * | 3/2002 | Lowenstein et al. | 392/498 |
| 6,574,426 | B1 | | 6/2003 | Blanco, Jr. | |
| 6,591,846 | B1 | * | 7/2003 | Ferguson et al. | 134/105 |
| 6,640,048 | B2 | | 10/2003 | Novotny et al. | |
| 6,744,978 | B2 | * | 6/2004 | Tweedy et al. | 392/451 |
| 6,989,514 | B2 | * | 1/2006 | Patterson et al. | 219/492 |
| 7,148,454 | B2 | * | 12/2006 | Chodacki et al. | 219/497 |

(Continued)

FOREIGN PATENT DOCUMENTS

JP 2-203151 A 8/1990

(Continued)

OTHER PUBLICATIONS

International Search Report and Written Opinion for International Application No. PCT/US2009/068667, mail date Jul. 29, 2010, 8 pages.

*Primary Examiner* — Thor Campbell
(74) *Attorney, Agent, or Firm* — Foley & Lardner LLP

(57) ABSTRACT

An exemplary embodiment includes a booster water heater for fluids, e.g., water, that has a reservoir for the fluids, at least one electrical heating element extending into the reservoir and a control system for applying an overload voltage to the heating element. In a more preferred embodiment, the booster water heater is used to preheat water in commercial dishwashing applications.

21 Claims, 5 Drawing Sheets

U.S. PATENT DOCUMENTS

| | | | | |
|---|---|---|---|---|
| 7,206,506 | B2 | 4/2007 | Sturm | |
| 7,209,651 | B1 * | 4/2007 | Knoeppel et al. | 392/451 |
| 7,257,321 | B2 * | 8/2007 | Kaastra | 392/459 |
| 7,620,302 | B2 * | 11/2009 | Lesage et al. | 392/454 |
| 7,672,576 | B2 * | 3/2010 | Grossbach et al. | 392/463 |
| 2001/0009609 | A1 | 7/2001 | Bradenbaugh | |
| 2003/0138244 | A1 | 7/2003 | Long et al. | |
| 2003/0194228 | A1 | 10/2003 | Bradenbaugh | |
| 2005/0013595 | A1 | 1/2005 | Israelson et al. | |
| 2005/0147401 | A1 * | 7/2005 | Baxter | 392/454 |
| 2006/0027673 | A1 | 2/2006 | Fabrizio | |
| 2006/0083491 | A1 | 4/2006 | Knoeppel et al. | |
| 2006/0083498 | A1 | 4/2006 | Renoud-Grappin | |
| 2007/0177858 | A1 | 8/2007 | Knoeppel et al. | |
| 2008/0080844 | A1 * | 4/2008 | Miller et al. | 392/498 |

FOREIGN PATENT DOCUMENTS

| | | |
|---|---|---|
| JP | 07-083511 | 3/1995 |
| KR | 10-2005-90030 | 9/2005 |
| WO | WO 93/18632 A1 | 9/1993 |

* cited by examiner

METHOD AND SYSTEM FOR REDUCING RESPONSE TIME IN BOOSTER WATER HEATING APPLICATIONS

BACKGROUND

The subject matter described herein relates generally to the field of booster water heaters. Booster water heaters may be used, for example, to elevate the temperature of a rinse water supply for dishwashers. In particular, the subject matter described herein relates to activation response times associated with immersion-type electrical heating elements within booster water heaters.

Dirty dishware may harbor undesirable microbes (e.g., bacteria, molds, protozoa, and the like) and grime (e.g., waxes, dried-on and burned-on foods, lipstick marks, films, stains, and the like). Therefore systems have been designed for use in the commercial food service industry for cleaning and sterilizing dirty dishware, such as plates, bowls, dishes, utensils, glasses, mugs, and the like. However in some cases, a facility's main water heater may be limited in its capacity to produce water of temperatures hot enough for effective dishware sanitizing. For example, a rinse at a temperature cooler than desired (e.g., 140° F.) may be insufficient to kill microbes and/or melt fats and waxes of the grime.

A booster water heater may serve in a dishware sanitizing system by increasing the dishwashing rinse water temperature beyond the water temperature produced by a facility's main water heater. Higher temperature water will improve the sterilizing and cleaning performance of a sanitizing system. For example, adding a booster water heater in series with the facility's main water heater may allow for the production of a dishwashing sanitizing rinse water that is hot enough (e.g., 180° F.) to destroy the undesirable microbes and loosen the grime. Spraying action of the dishwasher may then remove the loosened grime and dead microbes, producing clean dishware.

SUMMARY OF THE INVENTION

One embodiment of the invention relates to a booster water heater. The booster water heater has a container for water, and the container has an inlet and an outlet. The booster water heater also has an immersion electrical heating element that extends into the container. Also the booster water heater has a controller. The controller is configured to adjust the electrical heating element voltage from a first voltage pattern to a second voltage pattern when a predetermined condition is met. The mean voltage of the first voltage pattern is at least 1.5 times greater than the mean voltage of the second voltage pattern.

Another embodiment of the invention relates to a fluid heater. The fluid heater has a container, and the container has an inlet and an outlet. The fluid heater also has an electrical heating element that is coupled to the container. The heating element is rated to operate at an operational level. The fluid heater also has a controller, which is configured to adjust the heating element voltage and/or current from an overload level to the operational level after a predetermined condition is met.

Still another embodiment of the invention relates to a method to reduce response time in an electrical booster water heater. One step in the method is supplying an overload voltage to the heating element until a predetermined condition is reached. Another step in the method is reducing the overload voltage to an operational voltage.

DETAILED DESCRIPTION OF THE PREFERRED EMBODIMENTS

Some booster water heaters raise water temperatures by converting electric energy into thermal energy, and then adding the thermal energy to water passing through the booster water heater. However, after activation an initial lag time may occur before the booster water heater is fully operational. A "response time" after the booster water heater has been activated refers to the duration of this initial lag time period, which is necessary for the booster water heater's heating elements to warm up and reach an operating temperature. During the response time, a reservoir of sufficiently hot water in a storage vessel may temporarily supplement a dishwasher demand for hot water. Then following the response time, the booster water heater should be able to produce a continuous flow of hot sanitizing rinse water.

Embodiments presently claimed allow for a reduction of a booster water heater's response time. According to an embodiment, an immersion-type heating element reaches operating temperature in a matter of seconds; whereas without the technology, response times may be several minutes. A reduced response time allows for a corresponding size reduction of the booster water heater reservoir volume in some embodiments. The reduced reservoir volume requirements allow for booster water heater embodiments to be designed with smaller internal tanks (or storage vessels, such as pipe segments with heating elements or small reservoirs), and correspondingly compact structures. In other embodiments, the reduced response time allows for a booster water heater embodiment without a water reservoir altogether.

Figure 1:
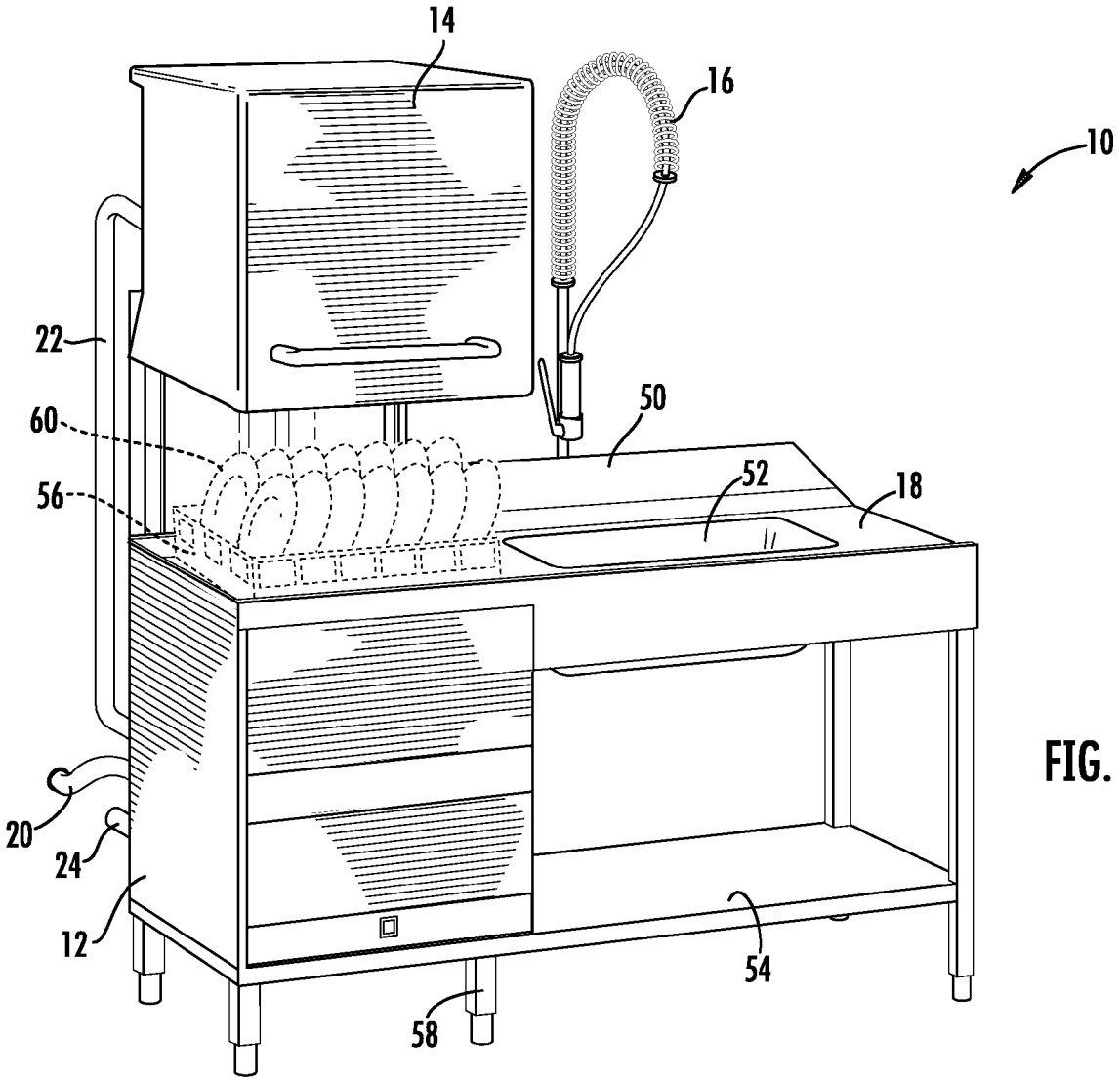
FIG. 1 is a perspective view of a dishware sanitizing system.

FIG. 1 shows a dishware sanitizing system 10, including a booster water heater 12 coupled to a dishwasher 14. In the figure, a facility's plumbing directs a water flow into the system 10 from a main hot water plumbing line 20 (e.g., pipe, hose, channel, tube, canal, conduit, pipeline, duct, or the like). The water flow enters the booster water heater 12, where the water flow is heated. A pipe 22 then directs the flow of the elevated-temperature water from the booster water heater 12 into the dishwasher 14, where dishware 60 is cleaned. Grime and microbes are picked up in the water flow, converting the water flow to waste water. The waste water then exits the system 10 through a pipe 24. Dishware sanitizing system 10 additionally includes a spray hose 16, a countertop 18 with a splash guard 50, a sink 52, a shelf 54, a dishware rack 56, and legs 58.

In some embodiments, the booster water heater 12 and dishwasher 14 are sub-parts of the same overall structural unit (e.g., a combination dishwasher and booster water heater unit). In other embodiments the booster water heater 12 and dishwasher 14 are separate stand-alone units coupled via plumbing. In an exemplary embodiment, a dishwasher stacks below a booster water heater. In another exemplary embodiment, a dishwasher and a booster water heater are located side-by-side. However, due to limited space (e.g., in a small, packed kitchen area) it may be inconvenient to place a booster water heater in close proximity to a dishwasher. So in yet another embodiment, a dishwasher and a booster water heater are placed apart from each other, but still coupled via plumbing.

Figure 2:
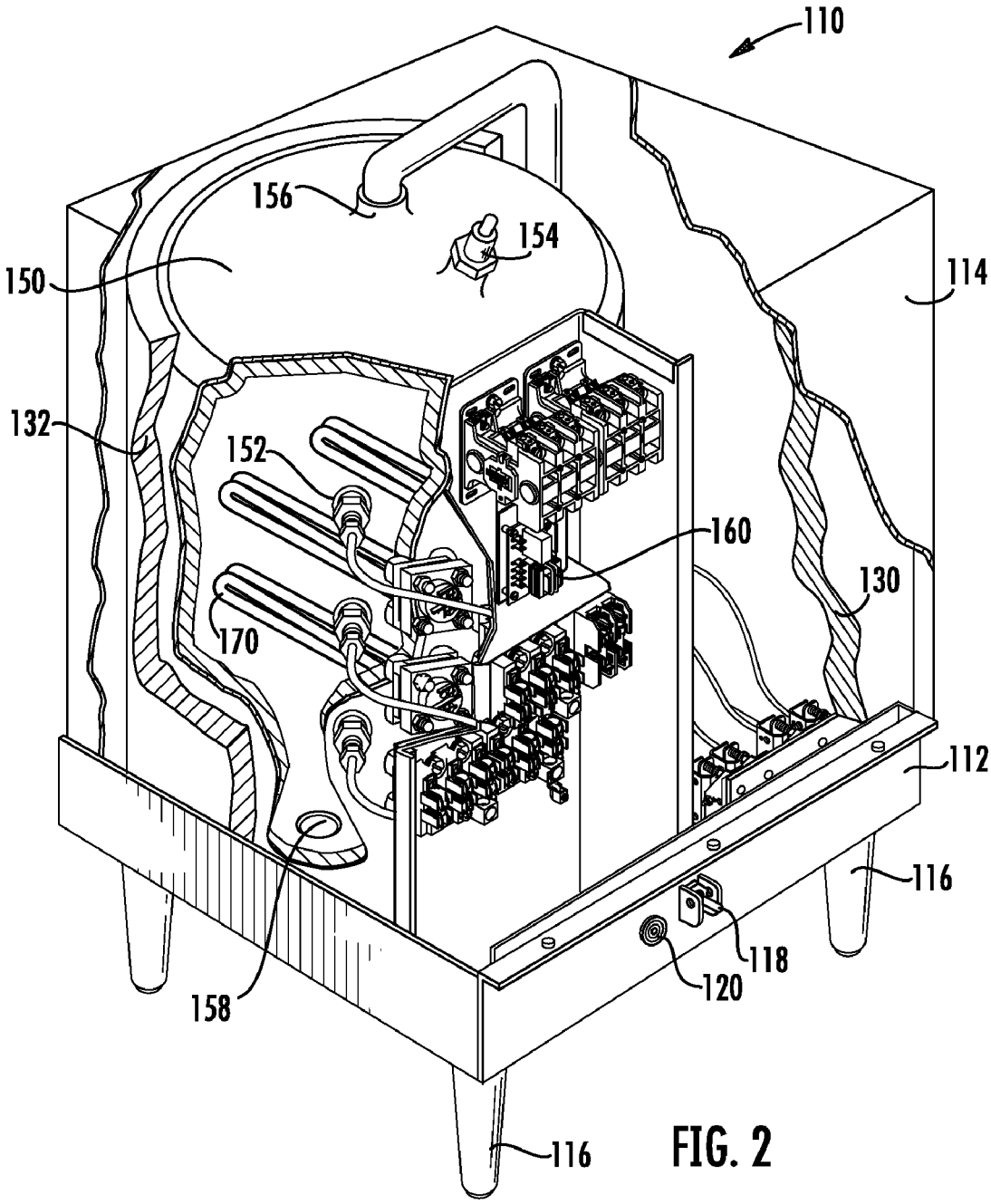
FIG. 2 is a broken-away view of a booster water heater.

FIG. 2 shows a broken-away view of an embodiment of a booster water heater 110, which may operate in a dishware sanitizing system, such as system 10. The booster water heater 110 includes a support base 112, an exterior shell 114, legs 116, a toggle 118 (e.g., an on/off switch), and an indicator light 120. Further referring to FIG. 2, booster water heater 110 includes internal components, such as shell insulation 130, tank insulation 132, a temperature sensor 152, a relief valve 154, a water outlet port 156, a water inlet port 158, and a control panel 160 for regulating electricity, the latter preferably including an internal digital clock and data recorder.

Also shown in FIG. 2, the booster water heater 110 includes a tank 150 and at least one immersion electrical heating elements 170, which extends into the tank 150 (or a type of storage vessel). As water fills tank 150, the portion of the heating element 170 within tank 150 comes into contact with the water and is immersed therein. Electricity (e.g., 120 V alternating current, or other voltage or current as discussed below) is directed to heating elements 170 via a power cable, where it is converted into thermal energy (also as discussed below).

Booster water heaters "boost" a water flow's temperature, but the magnitude of water temperature increase varies depending upon particular booster water heater embodiments and applications. Exemplary booster water heater embodiments of the present invention raise water temperature by approximately 30° F.; that is the water exiting the booster water heater is 30° F. warmer than the water entering it. Various other embodiments raise the initial water temperature by approximately 40° F., 50° F., 60° F., 70° F., or more. Some embodiments raise a water temperature less than 30° F. Further booster water heater embodiments may be adjusted to switch from a first magnitude of water temperature increase (e.g., 45° F.) to a second magnitude of water temperature increase (e.g., 75° F.). Still other booster water heater embodiments may be adjusted to raise water temperature over a spectrum of temperature increase possibilities, such as from a 1° F. increase to a 212° F. increase (e.g., increasing the temperature of a nearly-frozen water to a boiling water). Other exemplary booster water heater embodiments may allow for an increase in water temperature ranging from a 1° F. increase to a 80° F. increase. While still other booster water heater embodiments add a steady rate of thermal energy to a water flow, regardless of entering and exiting water temperature and flow rate.

Variant booster water heater embodiments of the present invention are configured to satisfy different hot water temperature needs. For example, a particular dishwasher may have a certain desired hot water temperature for water to be delivered from a booster water heater. At least one exemplary booster water heater embodiment produces a hot water sanitizing rinse with water exiting at approximately 180° F. Other exemplary embodiments produce water exiting at temperatures between about 170° F. and about 190° F. Some variations in water temperature exiting a booster water heater may be a function of flow rate changes and differences in temperatures of water flow entering the booster water heater as well as heating element efficiency. In certain preferred embodiments hot water between 175° F. and 185° F. is produced. In some preferred embodiments exit temperatures, accounting for heat losses, allow for 180° F. or hotter water to be emitted from a dishwasher rinse head (according to National Sanitation Foundation (NSF) guidelines).

Before a heating element has reached operating temperature, some booster water heater embodiments of the invention use a reservoir of hot water to satisfy a dishwasher's need for hot rinse water at a desired high temperature. In some embodiments, the reservoir is a tank, such as tank 150. The booster water heater's reservoir volume is designed based on a particular heating element response time and an expected flow rate demand. For example, variant booster water heater embodiments have average flow rates ranging from 40 gallons per hour (gph) to 573 gph for a 40° F. water temperature rise. Additional variant embodiment booster water heaters have average flow rates ranging from 23 gph to 326 gph for a 70° F. water temperature rise. Dishwashers requiring higher flow rates of hot water may require booster water heaters with larger-volume reservoirs.

Other booster water heater embodiments of the invention include tanks of varying volumes. For example, a smaller-sized booster water heater tank may only hold one gallon or less, while larger-sized embodiments may hold far more than one gallon, such as fifty gallons or more. For example, one embodiment has a 16.5 gallon tank (and uses about 60 kW of power when active). Preferred embodiments include tanks with volume capacities between three to thirty gallons. However, still other booster water heater embodiments do not require tanks, such as an embodiment that includes a pipe vessel fitted with heating elements.

The tank 150 in FIG. 2 is a vertically-oriented cylindrical container. In some exemplary embodiments, the tank could be horizontally-oriented and could be spherical in shape. Spherical and cylindrical tank shapes tend to be stronger pressure vessels, able to withstand a greater pressure differential between the interior and exterior of the tank. However, a heater tank, which is prism-shaped, is within the scope of the invention, as are other shapes.

In an exemplary embodiment, thermal energy is supplied to a hot water reservoir in tank 150 to maintain a desired hot water temperature. However, because tank insulation 132 cannot be perfect, energy continuously flows from the hot water reservoir. In particular embodiments, energy lost from a reservoir is proportional to the reservoir volume. But recall that reducing a heating element response time may allow for a reduced hot water reservoir volume because less stored hot water will be needed to supplement the system. Therefore, with regard to energy loss the following general relationships exist: booster water heater efficiency is inversely related to reservoir volume; reservoir volume is positively related to the heating element response time; and thus, decreasing the response time increases booster water heater efficiency.

A dishware sanitizing system's energy efficiency is also related to the distance water must travel from a booster water heater to a dishwasher. Heat energy may be lost through the plumbing. Placing a booster water heater further from a dishwasher increases heat loss. Additionally, longer plumbing lines generally increases the volume of standing water in the in the overall system. Therefore, placement of a booster water heater in close proximity to a dishwasher may enhance energy efficiency. Furthermore, a smaller tank and correspondingly more-compact booster water heater structure, such as those allowed by embodiments of the present invention, may allow for closer placement of a booster water heater to a dishwasher in a space-limited area and increase system efficiency.

The number, type, and arrangement of heating elements in a booster water heater tank will vary depending upon a number of factors. In some embodiments, a plurality of electric resistance heating elements (e.g., two to twelve, or more) are configured to extend into the interior of a booster water tank. Other embodiments use electric induction heating elements. Some embodiments use only one heating element. In other embodiments the heating elements do not extend into the interior of a tank, but instead are positioned around the outside of the tank, with heat being conducted through the tank walls into water contained within the tank. Still other embodiments use heating elements embedded within a tank's walls. In general it is preferred to employ immersion-type heating elements to prevent the heating elements from burning-out (i.e., a "dry fire" condition). In at least one embodiment system, one or more immersion electric resistance heating elements extend into a pipe through which water passes. No tank is included in the system.

Figure 3:
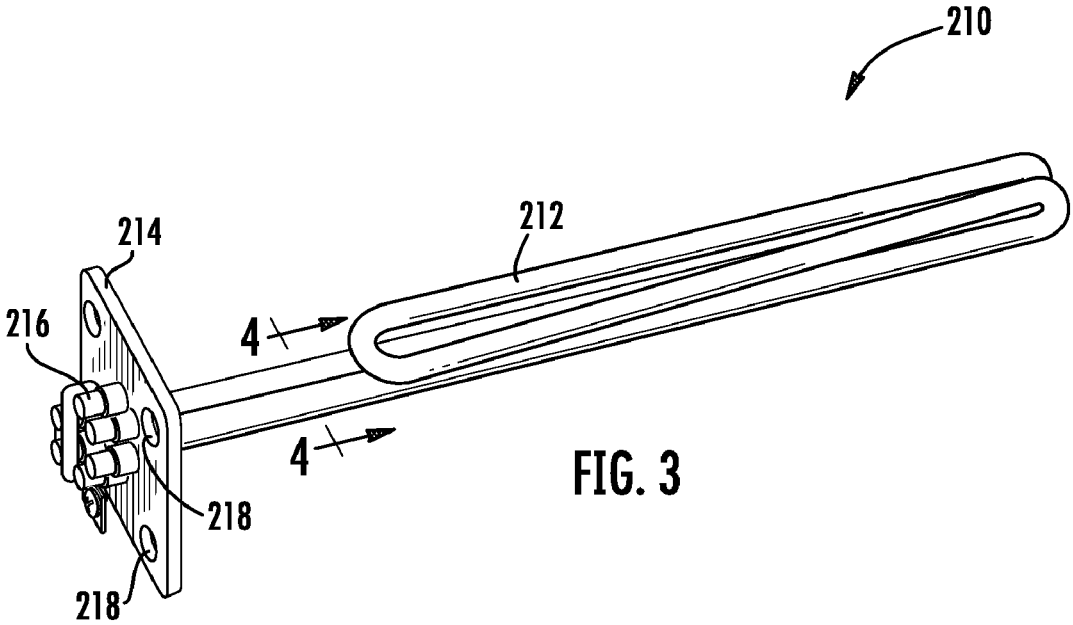
FIG. 3 is a perspective view of an electric resistance heating element.

FIG. 3 shows a perspective view an exemplary electric resistance heating element 210, which includes a sheath 212, a flange 214, a plug 216, and a plurality of attachment ports 218. Heating element 210 is functionally analogous to the electrical heating element 170 of booster water heater 110, such that heating element 210 is configured to convert electric energy to thermal energy and then transfer the thermal energy to water. Additionally, heating element 210 is an immersion electric resistance heating element that is configured to be submerged in water. A main flow of electricity enters and exits the heating element through the plug 216. The heating element flange 214 attaches to a container wall, and is coupled to a gasket (not shown) with bolts extending through the gasket and attachment ports 218 (e.g., bolt holes; screw holes). Tightening the bolts establishes a seal between the flange 214 and the wall of tank 150, wherein the wall and seal are substantially impermeable to water.

Figure 4:
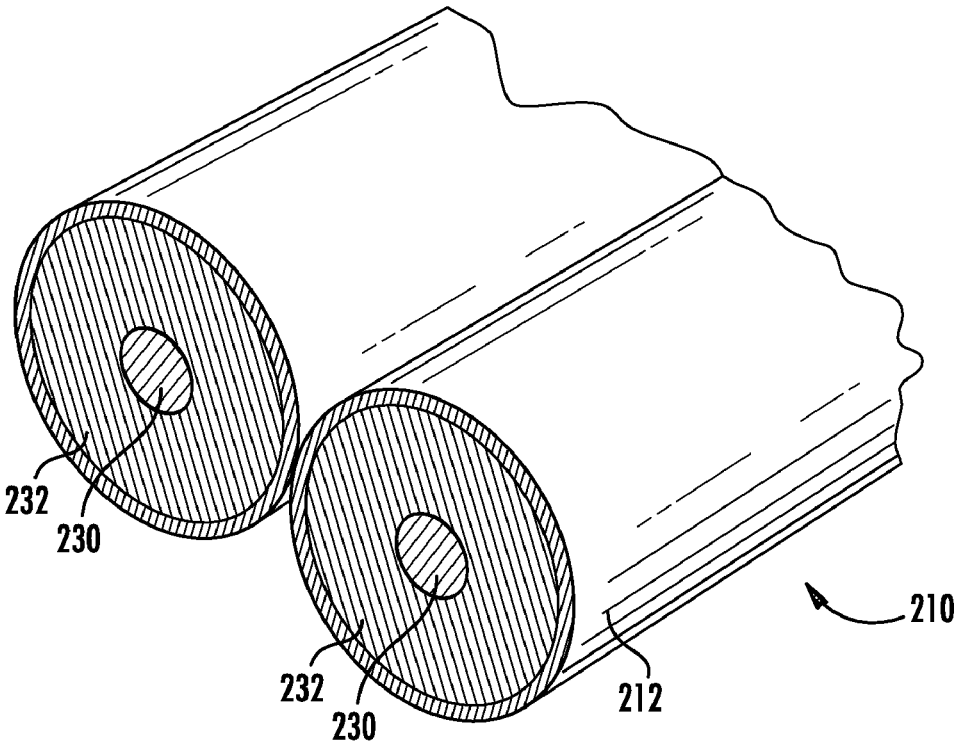
FIG. 4 is a cross-sectional view of the electric resistance heating element of FIG. 3.

FIG. 4 is a cross-sectional view of the heating element 210, where internal heating element layers can be seen. The central layer within the heating element is an electrically conductive core 230 having an electrical resistivity. As electricity flows through the core 230, electric energy is converted to thermal energy. In at least one embodiment, core 230 includes an electrically-resistive wire, such as a metal film resistance wire (e.g., nickel-chromium; bismuth ruthenate; lead oxide). Surrounding the core 230 is a layer of electrical insulation 232, and the outside layer is the sheath 212. In exemplary embodiments of the invention, the insulation layer 232 is an electrical insulator and obstructs a transfer of electricity from the core 230 to the sheath 212 (and ground). However, some quantity of electricity may still transfer through the insulator 232, which may then ground. In some embodiments, the insulator layer 232 material is a compressed inorganic powder, such as a compressed mineral (e.g., magnesium oxide; porcelain) insulation. While the insulator layer 232 is an electrical insulator, thermal energy (i.e., heat) may be conducted from the core 230 through the insulation layer 232 to the sheath 212. In preferred embodiments, the heating element sheath 212 is constructed from a metallic and thermally conductive material, such as copper or stainless steel, and includes an elongate shape.

Thermal energy is emitted through the heating element sheath 212 and transferred to water surrounding the heating element 210 through a process of thermal convection. In some embodiments, water flows past the heating element 210, forcing convection at a rate proportional to the water flow rate. As thermal energy is added to the water, the water heats up. Once the heating element 210 has reached operating temperature, a constant water flow rate produces a continuous stream of heated water.

Variant booster water heater embodiments include heating elements that differ in dimensions, materials, and specific use. While heating elements may require replacement from time to time due to burn out (e.g., once or twice a year), elements may be rated to sustain a particular operational voltage level for an extended duration (e.g., one hour; twenty minutes) without substantial element degradation or burn-out (e.g., melting a core or a sheath; damaging an insulator layer; short-circuiting the element). For example, industrial heating elements may have high-capacity resistor cores (e.g., rated for greater than 480 V), thick insulator layers (e.g., exceeding a half inch), and robust sheaths able to support the weight of the internal layers. Other variant embodiments include smaller heating elements rated for use with voltages below 480 V, such as 240 V to 108 V power sources, like the heating element 210 which is rated for use with a 120 V alternating current (AC) source. In some cases, due to structural limitations (e.g., thickness of the insulator; capacity of the core), a heating element may be rated with an "upper design limit" voltage. Raising the voltage above the upper design limit (i.e., an "overload voltage") for an extended duration may cause substantial element degradation, and/or an excessive waste of electricity.

Uncontrolled overloading can damage electronic devices, melt wires, destroy insulation, and burn-out circuits. As a result, overload protection devices have been created to prevent overload damage to electronic devices and electrical systems (e.g., surge suppressors; fuses; circuit breakers; current limiters). However, it has been found by the present inventor that a controlled overload voltage and/or overload current for a short time duration will not cause substantial degradation in electrical heating elements if properly designed.

Figure 5:
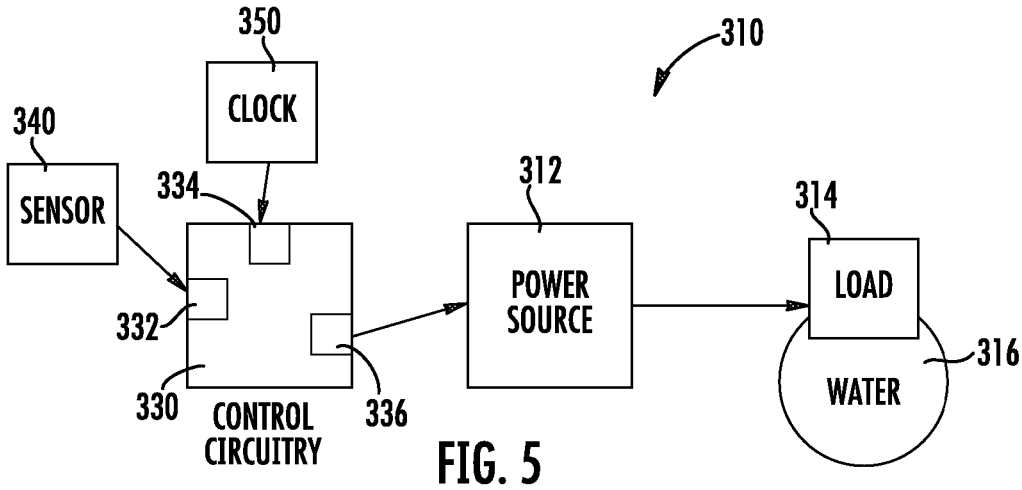
FIG. 5 is a block diagram a booster water heater with a controller.
Figure 6:
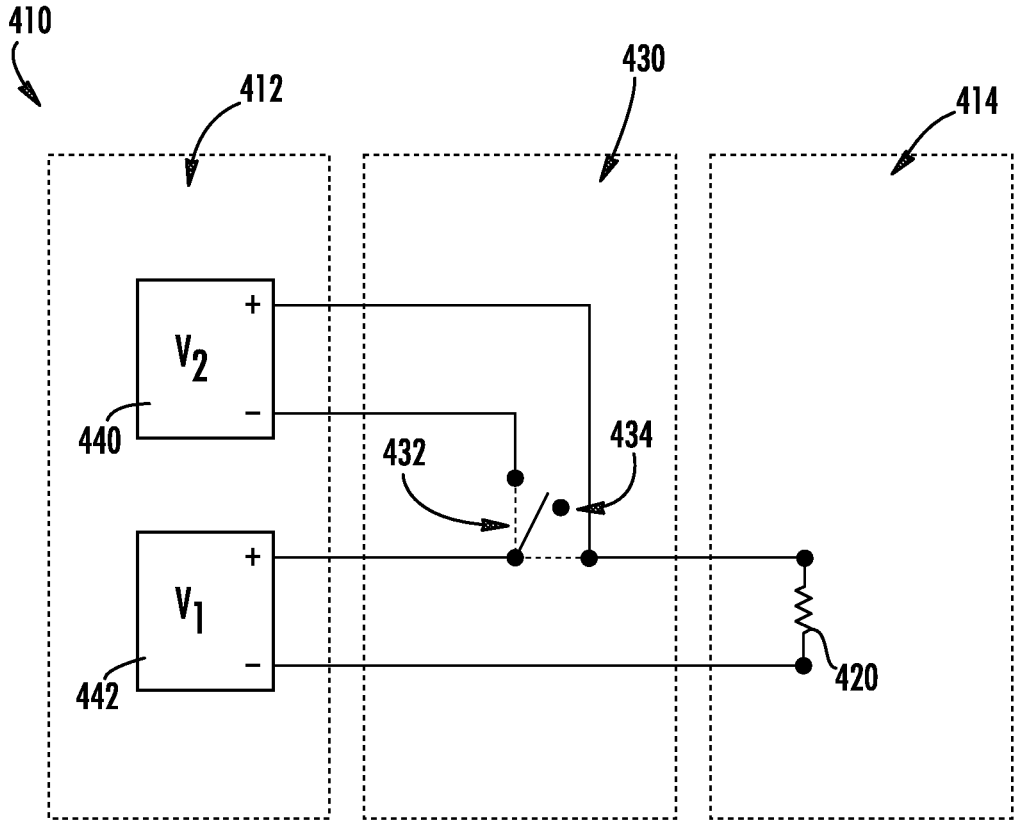
FIG. 6 is a first circuit diagram corresponding to the block diagram of FIG. 5.

FIGS. 5 and 6 both show booster water heater embodiments configured to intentionally supply an overload voltage and/or current in a controlled manner to heating elements in order to cause the heating elements to heat up faster than the elements would heat up at normal operational voltage and/or current levels, and therefore reduce heating element response times. FIG. 5 shows a block diagram of a booster water heater 310, including a power source 312 coupled to an electric load 314. In exemplary embodiments the electric load 314 includes a plurality of electrical heating elements. Electrical energy from the power source 312 is converted into thermal energy by the load 314. The thermal energy may then transfer to water 316. Variant booster water heater embodiments employ different forms of the power source 312, which include an AC source, a direct current source, a capacitor, an electric booster transformer, batteries, an outlet, a generator, and/or combinations of the like.

Also shown in FIG. 5 is a controller, such as control circuitry 330, which includes interfaces 332, 334 connected to a sensor 340 and a clock 350, respectively. In some embodiments, the clock is not required. In other embodiments, a control circuitry is only connected to a clock, and not a sensor. In still other embodiments, a control circuitry is connected to more than one sensor. The control circuitry 330 connects to the power source 312, and controls the amount of power that the power source 312 supplies to the load 312.

FIG. 6 shows a circuit diagram of a booster water heater 410 embodiment. Like booster water heater 310, the booster water heater 410 includes a power source 412, a controller 430, and a load 414. The power source 412 further includes a first voltage source 440 switchably coupled in series with a second voltage source 442. The controller 430 controls use of the voltage sources 440, 442 by operating a switch 432, which may close a circuit with only source 442; close a circuit with both sources 440, 442 in series; or open the circuits. Also coupled to the control circuitry 430 is a temperature sensor and a timer (not shown). The load includes a resistor 420. In some embodiments, an additional adjustable resistor connects to ground, and in other embodiments a voltage proportional to the power may be lost from the core through an imperfect electrical insulator layer.

In some exemplary embodiments, first and second voltage sources 440, 442 are 125 V sources. In other embodiments, first and second voltage sources 440, 442 are 250 V sources. In at least one embodiment, a first AC voltage source is 120 V and a second AC voltage source is 240 V. Other variant voltage sources have voltage levels ranging from 9 V to 5000 V. In another embodiment, upon activation the switch 432 switches from open to closing the circuit including sources 440 and 442, and then switches to closing the circuit with only source 442 (i.e., removing source 440 from the circuit). If the switch 432 is closed connecting source 440, both the second voltage source 442 and the first voltage source 440 supply electricity to the load 414. The combination of the first and second voltage sources 440, 442 generates an overload voltage in the load 414. However, if the switch 432 is closed only with respect to source 442, then an operational voltage level is supplied to the load 414.

Variant controllers 430 control electricity in the heating element 410 in various ways. In at least one exemplary embodiment, after a temperature sensor connected to the controller 430 reaches a threshold value predetermined by a user, the switch opens the circuit to source 440 and closes the circuit including 442, halting the current flowing from the first voltage source 440. In other embodiments, the controller 430 operates the switch 432 based upon a predetermined amount of time measured by the timer. In another embodiment, a voltmeter sensor measures voltage through the load 414, and the controller 430 converts the voltage into a power flow parameter. The controller 430 includes a data recorder that records the power flow parameter and corresponding time from the timer, which then quantifies the amount of electrical energy that has been delivered to the heating element 410 by numerically integrating the power with respect to time. After a particular amount of energy has been delivered, the controller 430 opens the switch 432 or removes source 440 from the circuit by only closing the circuit with respect to source 442. Still other exemplary booster water heater embodiments may not require the switch 432 to be switched to remove source 440 from the circuit after the response time. For example, upon activation of the booster water heater a capacitor first voltage source 440, holding a surplus amount of electrical energy (i.e., charge), may be coupled to source 442 and connected into the resistor circuit by the controller 430 closing the switch 432. As the charge surplus transfers electricity to the circuit, it adds to electricity from source 442 and creates an overload voltage in the circuit. The charge capacity of the capacitor may be designed to have the surplus substantially fully deplete as the heating element approaches operational temperature. When the surplus has been substantially fully depleted, a substantially steady level of electrical energy transfers to the resistor primarily from the source 442, which is at an operational level.

It should be noted that in some booster water heater embodiments, the terms "operational level," "upper design limit," and "overload voltage and/or current" are levels intended to be defined with respect to a booster water heater's particular electric load 314 requirements, not a particular heating element's structural limitations. For example, in a booster heater application requiring a low heated water flow rate with a small desired increase in water temperature, an associated "120 V heating element" may have an operational voltage of 80 V with an upper design limit (under the circumstances) of 90 V. Heating element electricity in excess of 90 V will cause too great of a temperature increase in the water (i.e., upper design limit under the load requirements). In this example, an overload voltage may be 120 V. In a second example, for a booster heater application requiring a greater flow rate with a greater desired increase in water temperature (e.g., raising water temperature from 140° F. to 180° F.), a corresponding "120 V heating element" may have an operational voltage of 120 V with an upper design limit of 125 V. In this second example, an overload voltage may be 240 V. Additionally, in other exemplary booster water heater embodiments of the invention, electrical levels such as overload voltages, overload currents (e.g., as with an electrical induction heating element), overcharges, overvoltages, and overcurrents are various forms of electrical level overloads used to reduce response time.

One reason that an overload voltage increases a heating element's temperature faster than an operational voltage is the non-linear relationship between voltage into an electric heating element and thermal energy out of the heating element. The rate of thermal energy produced is a function of integrated power with respect to time. Electric power is proportional to the square of voltage. Thus, the amount of thermal energy produced by a heating element during a time interval is substantially proportional to the integral of the electric voltage squared with respect to that time interval. For example, doubling the heating element voltage may produce an overvoltage that more than doubles the rate of thermal energy produced. However, without controlled use as described herein, such an overvoltage may be damaging to a heating element.

In at least one embodiment, an electric voltage entering the heating element occurs at an overload voltage level during the response time, until the element approximately reaches operating temperature. Following the response time, the electric voltage is reduced by half to an operational voltage level. For example, voltage entering the heating element is 240 V during the response time, and then is reduced to 120 V. As discussed above, doubling the voltage amplifies the rate of electric energy converted to thermal energy in a heating element by increasing the electric power. In various other exemplary embodiments, the overload voltage ranges between about 1.25 and 5 times greater than the operational voltage during the heating element warm up. In one such embodiment, heating element response time was comparatively reduced from nearly three to four minutes (at a nominal voltage of approximately 120 V) to approximately ten seconds by doubling the heating element voltage. In some other embodiments, it is prophetically estimated that a heating element response time would be reduced by nearly a minute by amplifying the operating voltage by a factor of at least 1.5 during the heating element warm up. In some other embodiments it is estimated that the response time for a particular water heating application would be very short, e.g., less than a second duration, while in other variant embodiments, the response time would be approximately 30 seconds or more. In alternative exemplary embodiments, it is estimated that the response time would be approximately less than fifteen seconds, and preferably less than ten seconds.

In some embodiments the overload voltage and operational voltages are not steadily maintained at or above particular voltage levels. Instead the overload voltage and operational voltages are dynamic voltage patterns. For example, an overload voltage pattern may include overload voltage spikes between periods where the voltage is below the upper design limit. Additionally, the operational voltage may not be a steady voltage level, but instead the operational voltage may adjust in response to momentary conditions, such as higher temperature inlet water, reduced flow rate demand, fluctuations in power, and the like. However, steadily maintaining a voltage at or above a voltage level may increase the net energy transferred and decrease response time, such as supplying a 240 VAC voltage level to a 120 V rated heating element.

Figure 7:
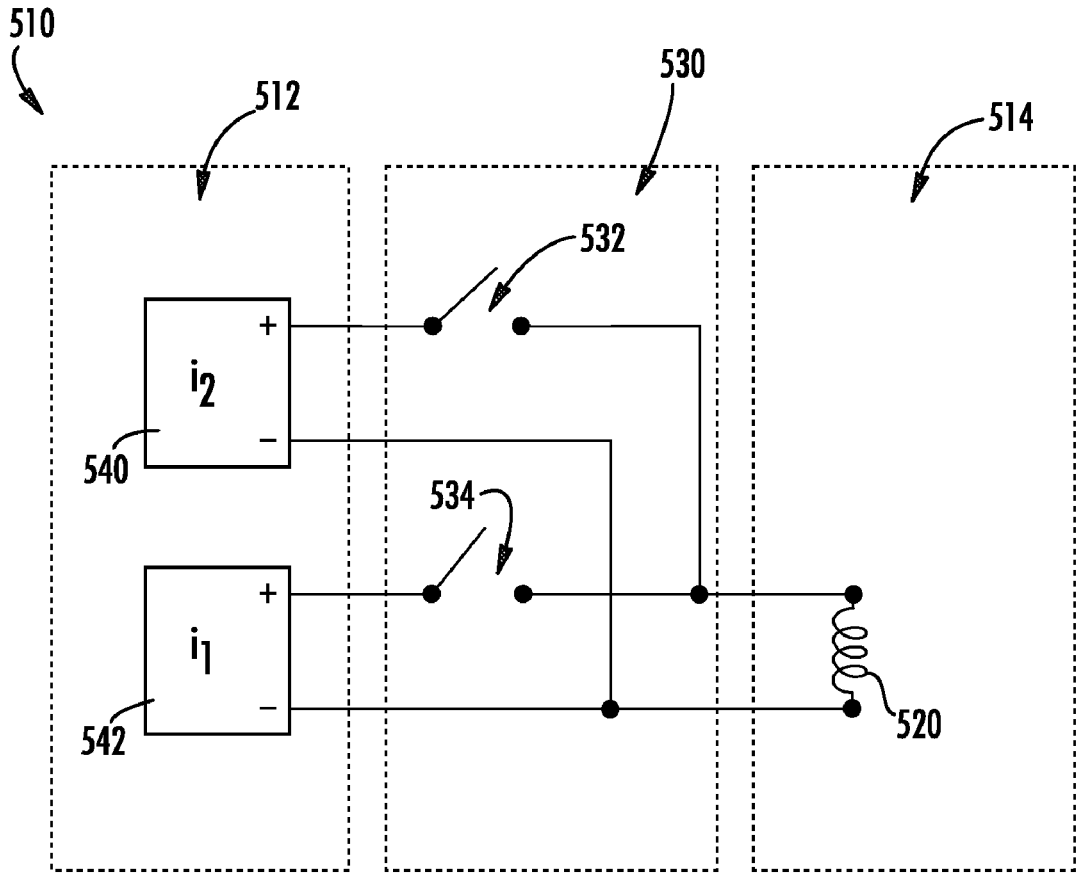
FIG. 7 is a second circuit diagram corresponding to the block diagram of FIG. 5.

The methods and teachings described herein to reduce response time for electric resistance heating elements may also be analogously applied to electric induction heating elements. FIG. 7 shows an induction heating element embodiment 510 that is analogous to the heating element 410 in FIG. 6. A controlled electric current is used in place of a controlled voltage. Exemplary embodiments with induction heating elements may have a plurality of current sources 540, 542 in parallel orientation coupled by switches 532, 534 to produce an overload current in an inductor coil 520. In some electric induction heating elements, as electric energy travels through the coil 520 surrounding a core, electric eddy currents are induced in the core heating up the core material. Heat then conducts from the core 520 through the heating element and into water by convection, similar to the process described with regard to heating element 210 in FIGS. 3-4. Electric induction heating elements have heating element lag times that are analogous to electric resistance heating elements, which may be reduced by supplying an overload current, and switching the overload current to an operational current after a predetermined condition has been met (e.g., an amount of time; a temperature of the coil; an amount of energy has been expended; and the like).

According to an exemplary embodiment of the invention, a booster water heater may include a controller that determines when to stop the overload current in a heating element by measuring a characteristic state of the sanitizing system relative to a predetermined condition, such as measuring a temperature with a thermo-sensor. When the thermo-sensor measures a temperature with regard to the heating element (e.g., water temperature; element surface temperature) that matches or exceeds a predetermined temperature value, then the controller switches the overload current to an operational current. In some embodiments, the thermo-sensor is coupled to a heating element. In other embodiments, the thermo-sensor measures the booster water heater exit water temperature. Still other embodiments use a timer, connected to the controller (instead of a thermosensor), to measure a characteristic time, such as the duration of time after the overload current has been initiated. In such embodiments, an exemplary controller is designed to switch from an overload current to an operational current after a predetermined amount of time has elapsed.

Water flow sensors can be designed to detect when hot water is being drawn from the booster water heater. In some embodiments, drawing of water from the booster water heater triggers the flow sensor, which signals the controller to activate an overload in the heating element. Still other booster water heater embodiments have an electrical sensor coupled to a dishwasher, where the dishwasher provides and electric signal to the electrical sensor instructing the booster water heater to activate the heating element.

A method of using a booster water heater system with an improved response time according to the present invention includes several steps, such as signaling the system to activate, ushering water into and out of the system, heating the water, initiating an overload voltage (and/or current) in a heating element, and reducing the voltage (and/or current) in the heating element. In some embodiments, signaling the system to activate includes sensing a demand for hot water, which may include receiving an electric signal and identifying the signal as a demand for hot water. In other embodiments, signaling the system to activate may include sensing a flow of hot water from the tank and notifying a controller of the flow. In certain embodiments, ushering water into and out of the system includes guiding the water through plumbing, which may include a series of pipes, containers, vessels, and tanks.

It is important to note that the terms used herein are intended to be broad descriptive terms and not terms of limitation. These components may be used with any of a variety of products or arrangements and are not intended to be limited to use with the structures illustrated in the drawings. While the components of the disclosed embodiments are illustrated as fixtures and equipment designed for booster water heaters (electric resistance heating elements, electric induction heating elements, etc.), the features of the disclosed embodiments have a much wider applicability. Booster water heaters with electrical heating elements are a subset of booster water heaters, which are a subset of water heaters, which are a subset of fluid heaters. For example in some embodiments, the improved response time technology may be employed in (non-booster) water heaters in general, heat exchangers, boilers, calorifiers/geysers, and the like. Also, the improved response time technology can be used when heating fluids other than water, such as oils, industrial chemicals, foods, and the like. Furthermore the booster water heater teachings of the invention can be used in commercial kitchen functions other than dishwasher rinsing, such as with a faucet pouring or spray handle washing. In still other booster water heater embodiments, hot water is used with washing machines (e.g., to wash clothing, towels, linens, etc.), car washes, hot tubs, community bathes/pools, cooking applications (e.g., hot water for making gelatin desserts; making oatmeal), sterilizing equipment (e.g., spraying down equipment in industrial food processing facilities). In other embodiments, heating elements are used to change the phase of a fluid (e.g., convert water to steam).

It is also important to note that the construction and arrangement of the elements of the booster water heater components as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, magnitudes, structures, shapes and proportions of the various elements, values of parameters, mounting arrangements, materials, colors, orientations, etc.) without materially departing from the novel teachings and advantages of the subject matter recited in the claims. For example, those skilled in the art would recognize that a tunable voltage and/or current source (e.g., with a varistor, potentiometer, other type of variable resistor, and/or the like) can be used in place of two or more independent voltage sources to facilitate different electricity levels or patterns in an electric heating element. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the appended claims.

What is claimed is:

1. A booster water heater, comprising:

a container for water having an inlet and an outlet;

an immersion electrical heating element extending into the container, the electrical heating element having an upper design voltage limit; and a controller configured to adjust the electrical heating element voltage from a first voltage pattern to a second voltage pattern when a predetermined condition is met, wherein the first voltage pattern comprises an overload voltage of the electrical heating element that is above the upper design voltage limit of the electrical heating element.

2. The booster water heater of claim 1, wherein a mean voltage of the first voltage pattern is at least 1.5 times greater than a mean voltage of the second voltage pattern.

3. The booster water heater of claim 1, wherein the first voltage pattern is a first voltage level and the second voltage pattern is a second voltage level.

4. The booster water heater of claim 1, wherein the electrical heating element is an electric resistance heating element.

5. The booster water heater of claim 1, further comprising a timer coupled to the controller, wherein the controller is configured to adjust the heating element voltage from the first pattern to the second pattern after a predetermined amount of time.

6. The booster water heater of claim 5, wherein the predetermined amount of time does not exceed fifteen seconds.

7. The booster water heater of claim 1, further comprising a temperature sensor coupled to the controller, wherein the controller is configured to adjust the heating element voltage from the first pattern to the second pattern after a predetermined temperature has been reached.

8. The booster water heater of claim 7, wherein the predetermined temperature is measured with regard to the heating element.

9. The booster water heater of claim 1, further comprising a voltmeter coupled to the controller and a data recorder coupled to the voltmeter, wherein the data recorder records a parameter that is a function of the measurements of the voltmeter with respect to time, and wherein the controller is configured to adjust the heating element voltage from the first voltage pattern to the second voltage pattern when a predetermined parameter has been recorded.

10. The booster water heater of claim 1, further comprising a dishwasher coupled to the outlet.

11. The booster water heater of claim 1, wherein the container is a vessel with a volume of a gallon or less.

12. The booster water heater of claim 1, wherein the container is a tank with a volume of more than a gallon.

13. A fluid heater, comprising:

a container having an inlet and an outlet;

an electrical heating element coupled to the container, wherein the heating element is rated to operate at an operational level; and a controller configured to adjust the electrical heating element voltage and/or current from an overload level to the operational level after a predetermined condition is met, wherein the overload level is above an upper design limit of the electrical heating element.

14. The booster water heater of claim 13, further comprising a timer coupled to the controller, wherein the predetermined condition is a predetermined amount of time measured by the timer, and wherein the predetermined amount of time is less than sixty seconds following the start of the overload level.

15. The fluid heater of claim 14, wherein the predetermined amount of time is less than fifteen seconds following the start of the overload level.

16. The fluid heater of claim 13, wherein the electrical heating element is an electric resistance heating element, and wherein the overload level is a first voltage level and the operational level is a second voltage level.

17. The fluid heater of claim 13, wherein the electrical heating element is an electric induction heating element, and wherein the overload level is a first current level and the operational level is a second current level.

18. The fluid heater of claim 13, further comprising a dishwasher coupled to the outlet.

19. A method to reduce response time in an electrical booster water heater, comprising:

supplying an overload voltage to a heating element having an upper design voltage limit, wherein the overload voltage is above the upper design voltage limit; and reducing the overload voltage to an operational voltage that is less than the upper design voltage limit once a predetermined condition is met.

20. The method to reduce response time in claim 19, wherein the predetermined condition is a water temperature.

21. The method to reduce response time in claim 19, wherein the predetermined condition is a time limit.

* * * * *